US011871846B2

(12) United States Patent
Duggins

(10) Patent No.: US 11,871,846 B2
(45) Date of Patent: Jan. 16, 2024

(54) HARDWARE ASSEMBLY FOR DRAWER SLIDE WITH DAMPENING MECHANISM

(71) Applicant: Tenn-Tex Plastics, Inc., Colfax, NC (US)

(72) Inventor: William Duggins, Kernersville, NC (US)

(73) Assignee: TENN-TEX PLASTICS, INC., Colfax, NC (US)

( * ) Notice: Subject to any disclaimer, the term of this patent is extended or adjusted under 35 U.S.C. 154(b) by 12 days.

(21) Appl. No.: 17/568,353

(22) Filed: Jan. 4, 2022

(65) Prior Publication Data

US 2022/0240672 A1 Aug. 4, 2022

Related U.S. Application Data

(60) Provisional application No. 63/143,086, filed on Jan. 29, 2021.

(51) Int. Cl.
*A47B 88/477* (2017.01)

(52) U.S. Cl.
CPC ..... *A47B 88/477* (2017.01)

(58) Field of Classification Search
CPC .... A47B 88/477; A47B 88/467; A47B 88/487
See application file for complete search history.

(56) References Cited

U.S. PATENT DOCUMENTS

| | | | | |
|---|---|---|---|---|
| 9,486,077 | B2 * | 11/2016 | Brock | A47B 88/493 |
| 2004/0000850 | A1 * | 1/2004 | Lam Harn | A47B 88/467 312/333 |
| 2006/0279186 | A1 * | 12/2006 | Lam | A47B 88/467 312/319.1 |
| 2007/0046159 | A1 * | 3/2007 | Hoffman | A47B 88/467 312/333 |

(Continued)

FOREIGN PATENT DOCUMENTS

| | | | | |
|---|---|---|---|---|
| AT | 520275 | A1 * | 2/2019 | A47B 88/467 |
| CN | 1619181 | A * | 5/2005 | A47B 88/047 |

(Continued)

*Primary Examiner* — Hanh V Tran
(74) *Attorney, Agent, or Firm* — Myers Bigel, P.A.

(57) ABSTRACT

An assembly is to be mounted on a drawer slide to provide dampening to a drawer for an enclosure. The enclosure includes a front wall having a cutout area with merging lower and side edges. The drawer slide includes a stationary member mounted to the enclosure and a sliding member attached to the drawer. The assembly includes; a dampening mechanism having front and rear ends, the dampening mechanism configured to prevent slamming of the drawer during closing and to maintain the drawer in a closed position, the dampening mechanism having a hook that engages an activator mounted on the drawer; a front mounting bracket attached to the front end of the dampening mechanism, the front mounting bracket configured to mount to and engage the side edge of the cabinet and the stationary member of the drawer slide; and a rear mounting bracket (Continued)

attached to the dampening mechanism rearwardly of the front mounting bracket, the rear mounting bracket configured to mount to and engage the stationary member of the drawer slide.

18 Claims, 7 Drawing Sheets

(56) References Cited

U.S. PATENT DOCUMENTS

2010/0123378 A1* 5/2010 Chen ..... A47B 88/467
312/333
2010/0295432 A1* 11/2010 Hightower ..... A47B 88/43
312/330.1
2011/0095670 A1* 4/2011 Cho ..... F25D 25/025
312/405.1
2011/0115353 A1* 5/2011 Domenig ..... A47B 88/463
312/333
2011/0175508 A1* 7/2011 Rechberg ..... E05F 3/108
16/49
2012/0269470 A1* 10/2012 Zimmer ..... E05F 1/16
384/20
2012/0288221 A1* 11/2012 Jahrling ..... A47B 88/47
384/20
2014/0042884 A1* 2/2014 Domenig ..... A47B 88/483
312/334.44
2014/0097732 A1* 4/2014 Xiao ..... A47B 88/467
312/319.1
2017/0135478 A1* 5/2017 Chen ..... A47B 88/467
2020/0093264 A1* 3/2020 Liao ..... A47B 88/477

FOREIGN PATENT DOCUMENTS

CN 110074570 A * 8/2019 ..... A47B 88/40
CN 111671254 A * 9/2020
DE 20315124 U1 * 4/2004 ..... A47B 88/467
DE 202008012997 U1 * 3/2010 ..... A47B 88/423
EP 1692969 A1 * 8/2006 ..... A47B 88/467
EP 2210525 B1 * 5/2018 ..... A47B 88/467
EP 3084107 B1 * 2/2020 ..... E05F 1/16
EP 3922136 A1 * 12/2021 ..... A47B 88/467
GB 2496864 A * 5/2013 ..... A47B 88/467
JP 2010269113 A * 12/2010 ..... A47B 88/14
JP 2013138825 A * 7/2013 ..... A47B 88/467
KR 200486921 Y1 * 1/2018
KR 20190119784 A * 10/2019
WO WO-2010011822 A1 * 1/2010 ..... A47B 88/0477
WO WO-2014124833 A1 * 8/2014 ..... A47B 88/493

* cited by examiner

HARDWARE ASSEMBLY FOR DRAWER SLIDE WITH DAMPENING MECHANISM

RELATED APPLICATION

The present application claims priority from and the benefit of U.S. Provisional Patent Application No. 63/143,086, filed Jan. 29, 2021, the disclosure of which is hereby incorporated herein by reference in its entirety.

FIELD OF THE INVENTION

The present invention is directed generally to furniture, and more particularly to cabinets with sliding drawers and trays.

BACKGROUND OF THE INVENTION

Many cabinets, particularly those found in kitchens, include drawers for storing various items. Often, drawers are mounted to the cabinet with elongate drawer slides that are fixed to the drawer. Each drawer slide has a slide member fixed to the drawer that slidably engages a stationary member that is fixed to the walls of the cabinet (often the slide member, the stationary member, or both include a small wheel that facilitates sliding motion). Some of such cabinets include multiple drawers, which can be disposed in vertically stacked fashion, side-by-side fashion, or both.

Some drawers have relatively simple drawer slides that are mounted on the sides of the drawer. These are often coated with epoxy (and hence are sometimes known as "epoxy drawer slides"). In some embodiments, drawers mounted with epoxy drawer slides may also employ dampening mechanisms (also known as "soft close" mechanisms) that encourage the drawer to close automatically, but without slamming. One style of dampening mechanism includes a hook or "catch member" that projects above the remainder of the dampening mechanism and is positioned to engage a projection (sometimes referred to as the "activator") mounted to the drawer as the drawer slides between open and closed positions. Such a mechanism is available from the Zimmer Group US (Hickory, North Carolina).

One issue that can arise with some dampening mechanisms is the inadvertent disengagement of the drawer from the dampening mechanism. This can occur when the drawer is raised during opening; the hook on the dampening mechanism can become dislodged from the activator on the drawer, which can prevent the drawer from closing completely. Thus, it may be desirable to provide improved components that expand on this mounting technique.

SUMMARY

As a first aspect, embodiments of the invention are directed to an assembly to be mounted on a drawer slide to provide dampening to a drawer for an enclosure, wherein the enclosure includes a front wall having a cutout area with merging lower and side edges, and the drawer slide includes a stationary member mounted to the enclosure and a sliding member attached to the drawer. The assembly comprises: a dampening mechanism having front and rear ends, the dampening mechanism configured to prevent slamming of the drawer during closing and to maintain the drawer in a closed position, the dampening mechanism having a hook that engages an activator mounted on the drawer; a front mounting bracket attached to the front end of the dampening mechanism, the front mounting bracket configured to mount to and engage the side edge of the cabinet and the stationary member of the drawer slide; and a rear mounting bracket attached to the dampening mechanism rearwardly of the front mounting bracket, the rear mounting bracket configured to mount to and engage the stationary member of the drawer slide.

As a second aspect, embodiments of the invention are directed to a mounting bracket for mounting a dampening mechanism to a stationary member of a drawer slide comprising: front, rear, inward and outward panels, wherein the front and rear panels are generally parallel, and the inward and outward panels are generally parallel to each other and generally perpendicular to the front and rear panels; and a first vertical wall extending rearwardly from the outward panel, the first vertical wall including a lower stop configured to engage the stationary member of the drawer slide.

As a third aspect, embodiments of the invention are directed to a mounting bracket for mounting a dampening mechanism to a stationary member of a drawer slide comprising: a main body with a lower shelf; a lower attachment portion extending downwardly from the lower shelf, the lower attachment portion configured to attach to the stationary member, and the lower shelf configured to engage an upper edge of the stationary member; and an upper mounting portion extending upwardly from the main body, the upper mounting portion configured to receive and attach to a rear end of the dampening mechanism.

DETAILED DESCRIPTION

Figure 1:
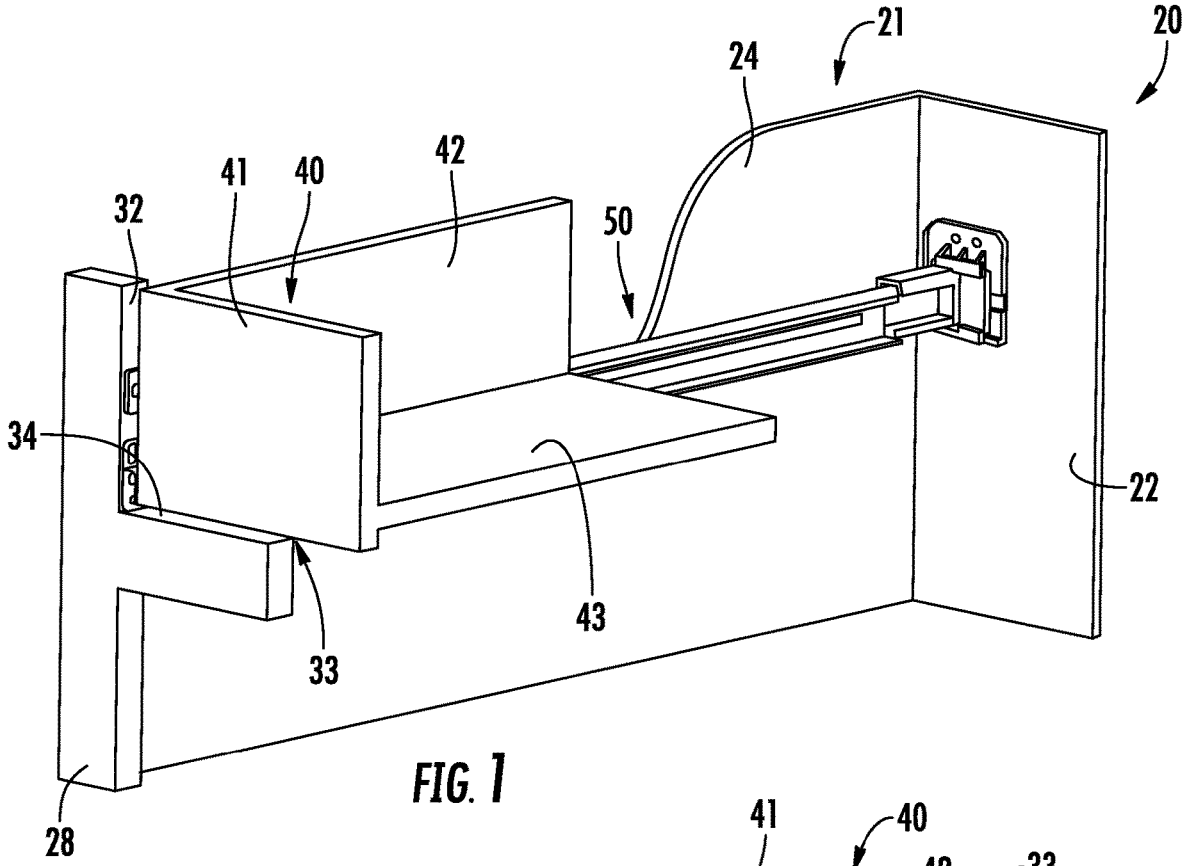
FIG. 1 is an interior, partial front perspective view of a cabinet with a drawer mounted therein with side-mounted drawer slides and a dampening mechanism according to embodiments of the invention.
Figure 2:
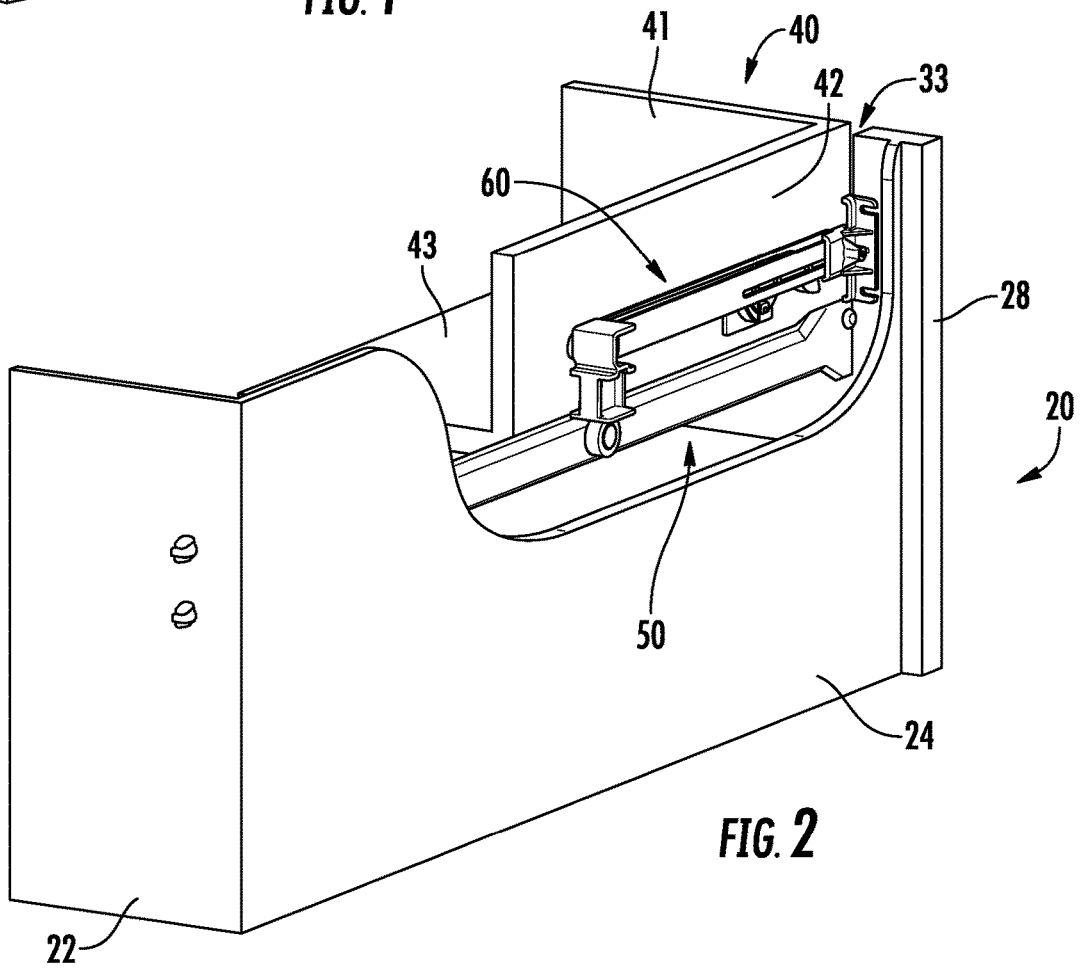
FIG. 2 is an exterior partial rear perspective view of the cabinet of FIG. 1.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

Referring now to FIG. 1, a cabinet, designated broadly at 20, is illustrated in FIG. 1. The cabinet 20 includes an enclosure 21 having a rear wall 22, side walls 24 mounted perpendicular thereto (only one side wall 24 is shown herein), and a front wall 28 mounted generally parallel to the rear wall 22. The front wall 28 has a cut-out area 33 that receives the front face of a drawer 40. The cut-out area is lined by a side edge 32 and a lower edge 34 that are disposed generally perpendicular to each other. Typically the enclosure 21 is formed of wood, but other materials known to be suitable for cabinets may also be employed.

Those skilled in this art will recognize that the configuration of the enclosure 21 can vary and still be encompassed by the present invention. For example, the enclosure 21 may have two or more cut-out areas 33 for multiple drawers 40.

As seen in FIGS. 1-4, the drawer 40 has a front wall 41, two side walls 42 (only one side wall 42 is shown herein), a rear wall (not shown), and a floor 43. The front wall 41 of the drawer 40 fits within the cut-out area 33 when the drawer 40 is closed.

A drawer slide 50 is employed to mount the drawer 40 within the cabinet 20. The drawer slide 50 includes an elongate stationary member 51 that is mounted to the rear wall 22 of the cabinet 20 and to the side edge 32 of the cut-out area 33 of the front wall 28, with the lower edge of the stationary member 51 resting on the lower edge 34 of the cut-out area 33. The drawer slide 50 also includes a sliding member 52 (FIG. 5) that engages the stationary member 51 and slides relative thereto. The sliding member 52 is mounted to the outer surface and underside of the side wall 42 of the drawer 40. The ability of the sliding member 52 to slide relative to the stationary member 51 enables the drawer 40 to slide between open and closed positions relative to the front wall 28 of the cabinet 20.

Those skilled in this art will recognize that, although a particular style of drawer slide is shown herein, other drawer slide styles may be suitable for use in embodiments of the invention.

Figure 3:
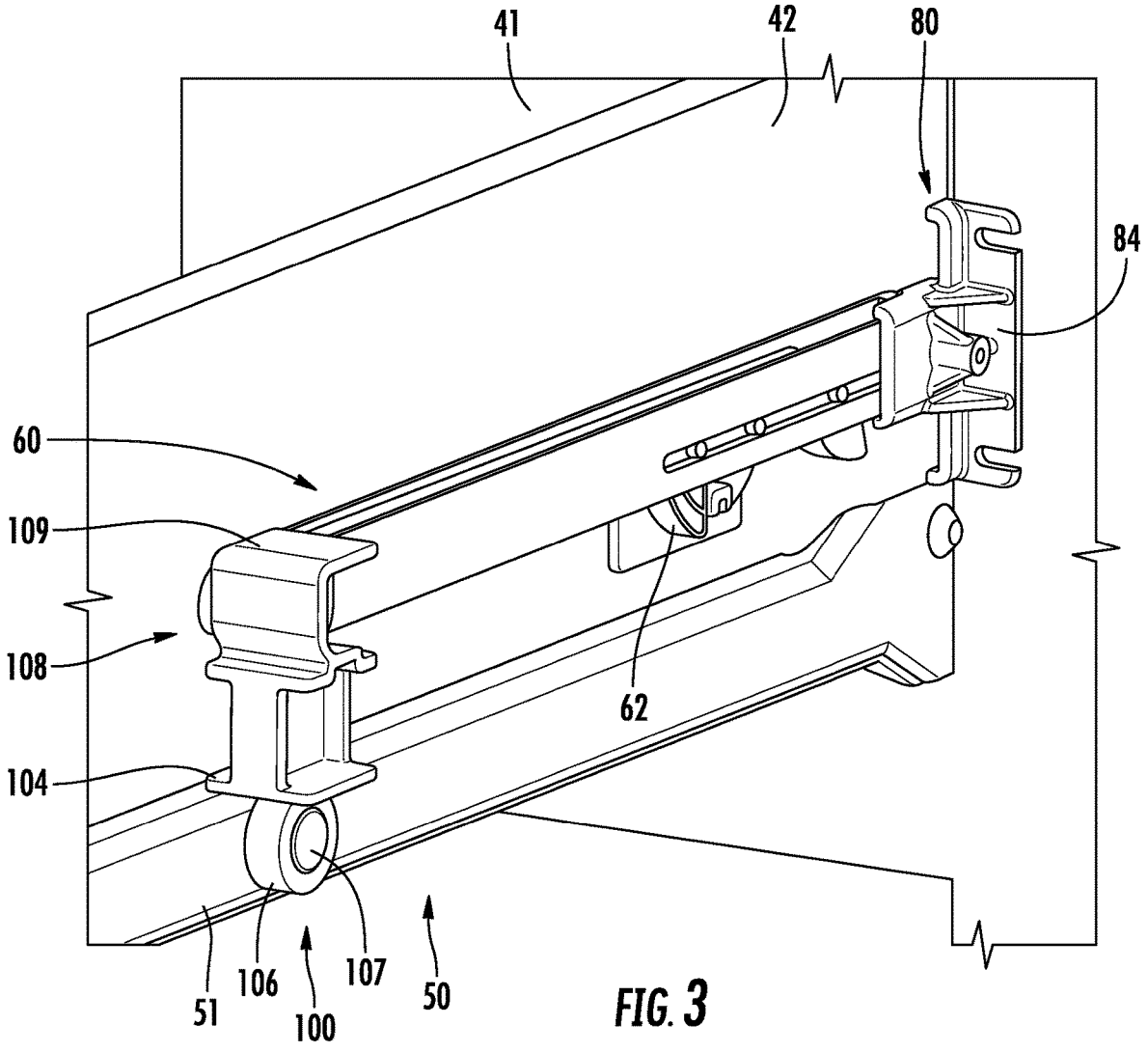
FIG. 3 is an enlarged rear perspective view of the front portions of the cabinet front wall, drawer and mounting hardware of the cabinet of FIG. 1.
Figure 4:
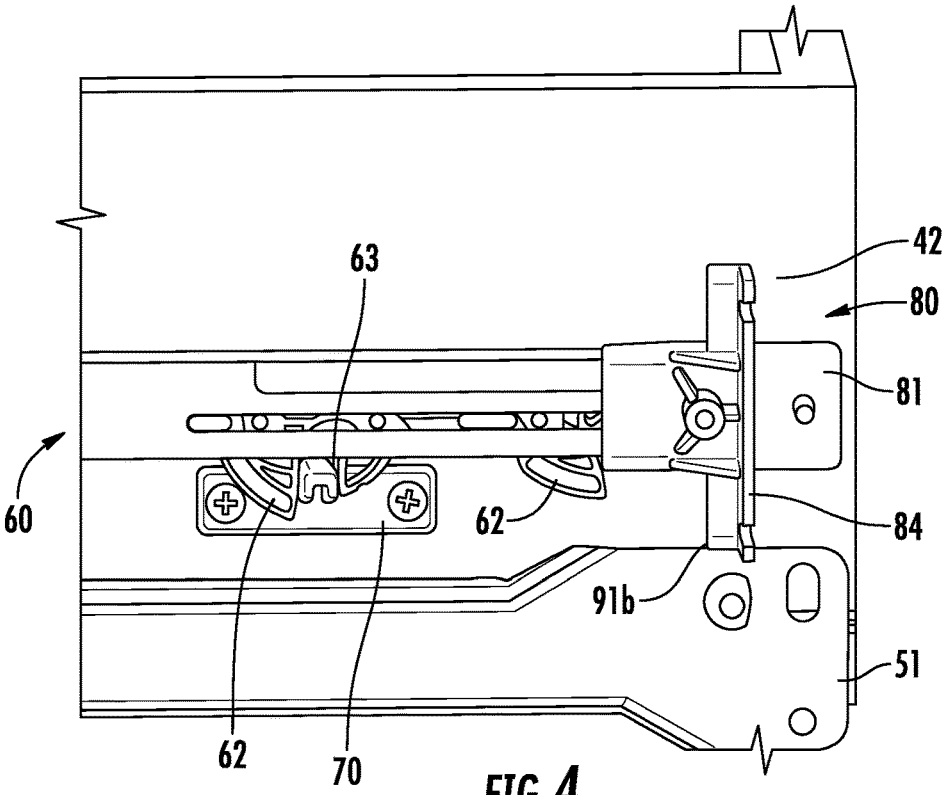
FIG. 4 is a side view of the drawer and hardware of the cabinet of FIG. 1 with the cabinet removed for clarity.
Figure 5:
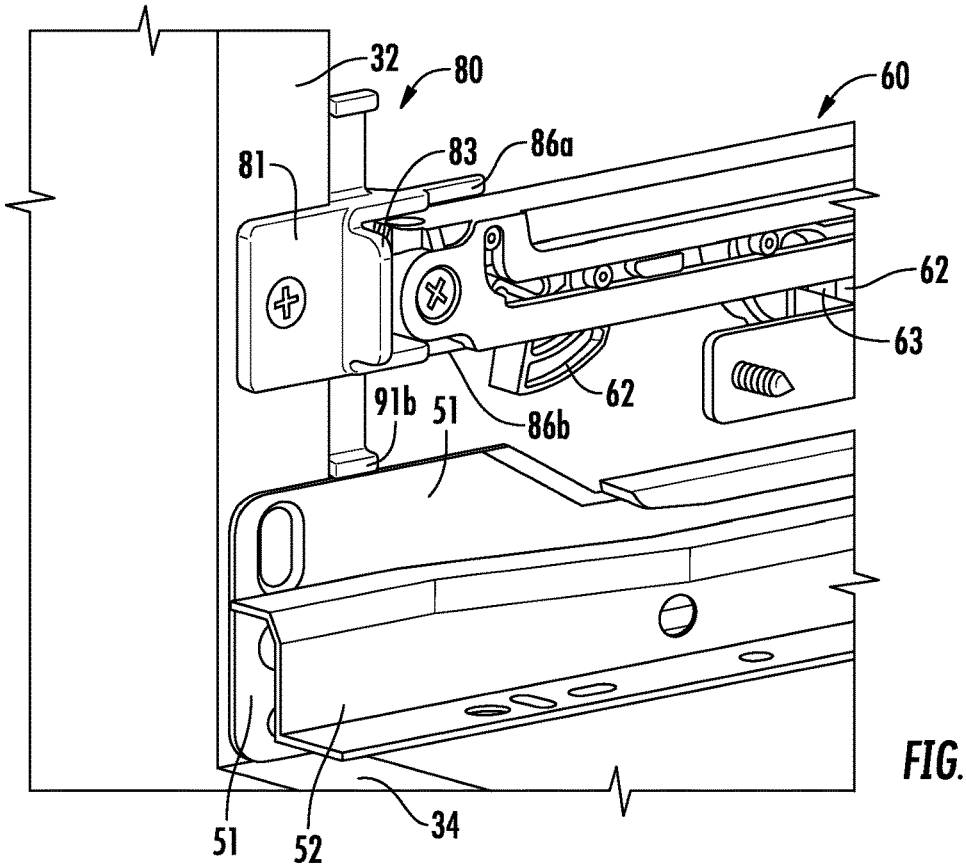
FIG. 5 is an interior, partial front perspective view of the drawer slide, dampening mechanism and front mourning backet of the cabinet of FIG. 1.

Referring to FIGS. 3-5, a dampening mechanism 60 is mounted to the front wall 28 of the cabinet 40 laterally from the cut-out area 33 via a front mounting bracket 80 and is attached to the stationary member 51 of the drawer slide 50 via a rear mounting bracket 100. The dampening mechanism 60 includes a hook 62 that protrudes from its lower surface. The hook 62 includes a slot 63. The hook 62 interacts with the catch member 72 of an activator 70 mounted on the side wall 42 of the drawer 40 to provide "soft closing" capability to the drawer 40. (It should be noted that the hook 62 of the dampening mechanism 60 is shown in both its forward and rear positions in FIGS. 2-5 and 7, with the front portion of the hook 62 hidden within the front portion of the dampening mechanism 60 in the forward position). Details regarding the activator 70, the rear mounting bracket 100 and the front mounting bracket 80 are provided below.

Figure 6:
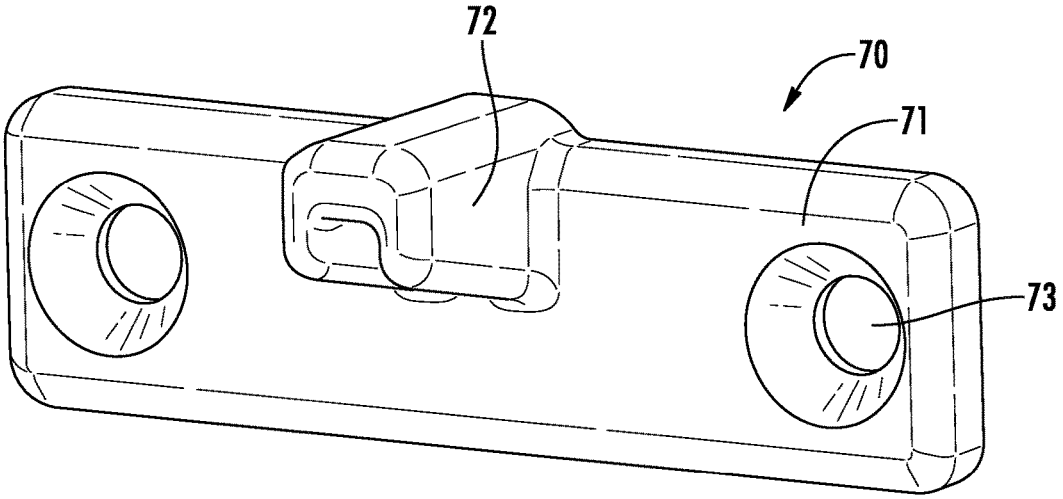
FIG. 6 is a front perspective view of the activator of the hardware for the cabinet of FIG. 1.
Figure 7:
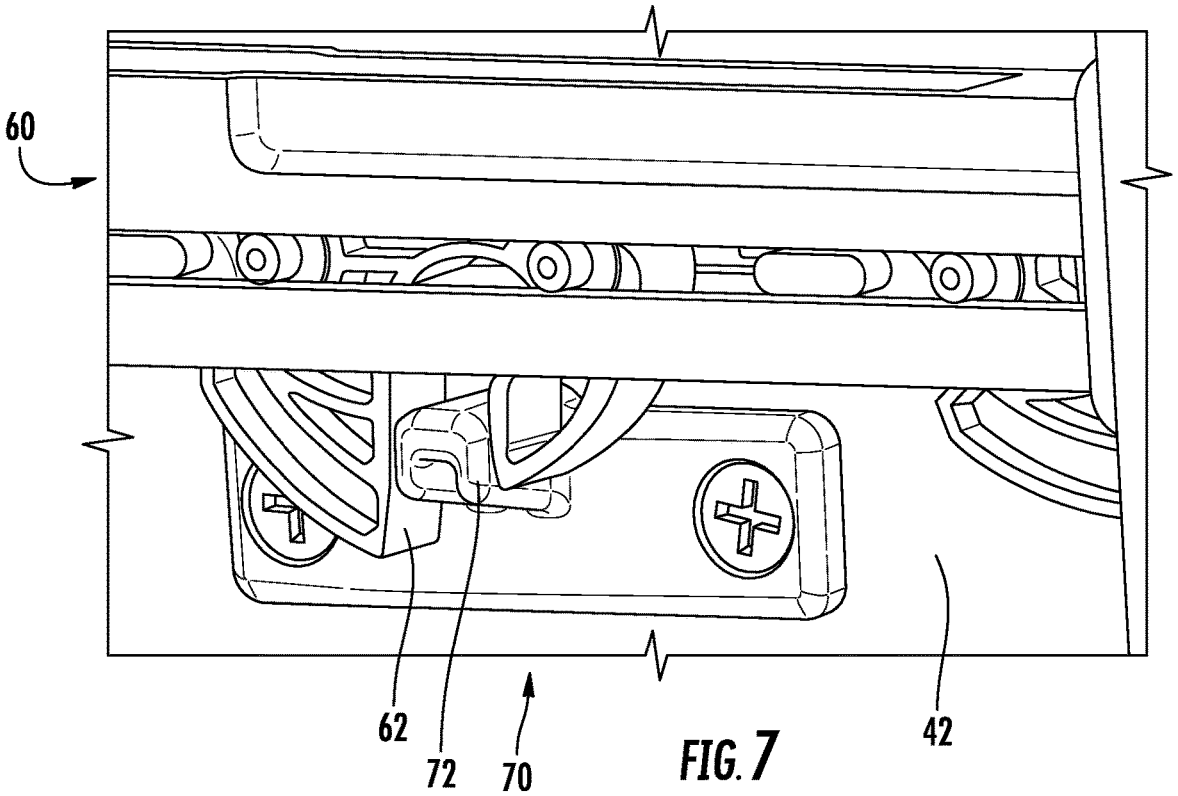
FIG. 7 is a perspective view of the activator of FIG. 6 engaged with the hook of the dampening mechanism of the cabinet of FIG. 1.

Referring to FIGS. 6 and 7, the activator 70 includes a planar main body 71 with mounting holes 73 near each end. A catch member 72 extends from the upper central portion of the main body 71. The catch member 72 is generally U-shaped in profile and is tapered slightly from its fixed end to its free end. The activator 70 is mounted to the side wall 42 of the drawer 40 via screws inserted through the mounting holes 73.

Figure 8:
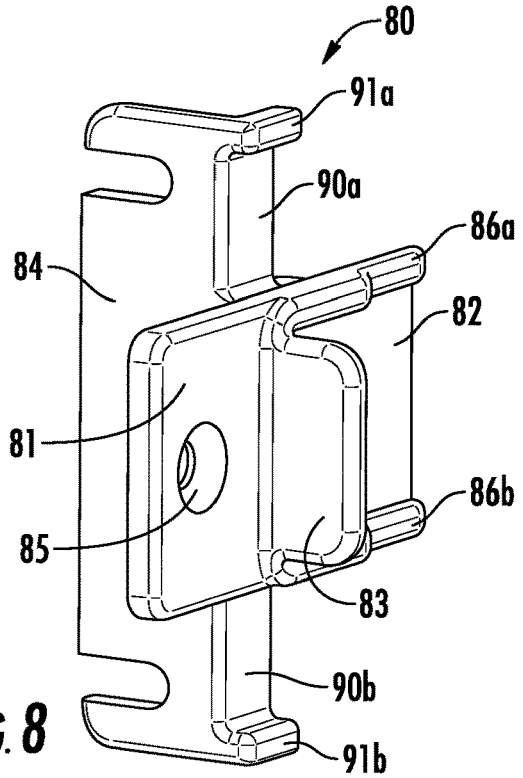
FIG. 8 is a front perspective view of front mounting bracket of the mounting hardware for the cabinet of FIG. 1.
Figure 9:
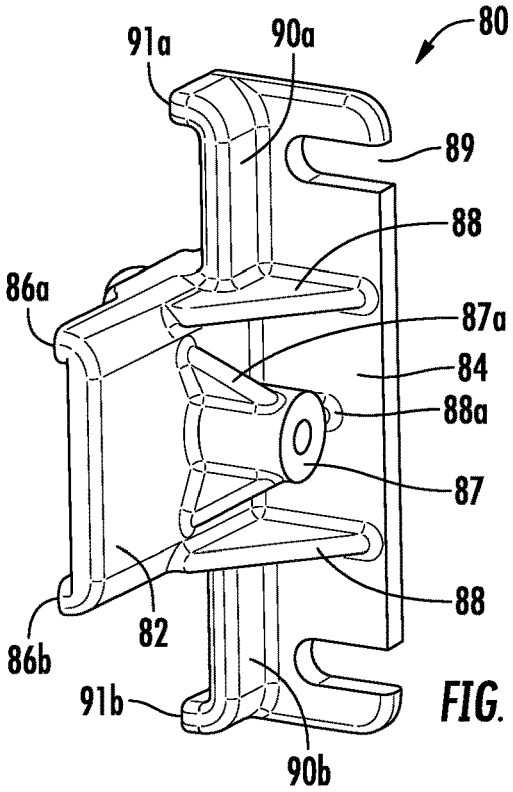
FIG. 9 is a rear perspective view of the front mounting bracket of FIG. 8.

Referring now to FIGS. 8 and 9, the front mounting bracket 80 includes interconnected front, back, inward and outward panels 81, 82, 83, 84. The front and rear panels 81, 82 are slightly offset laterally, with the front panel 81 being positioned slightly inward of the rear panel 82. A mounting hole 85 is present in the front panel 81 for mounting of the front mounting bracket 80 to the side edge 32 of the cutout area 33. Upper and lower flanges **86*a*, 86*b* extend inwardly from the top and bottom edges of the rear panel 82 (the flanges 86*a*, 86*b* can help to prevent the dampening mechanism 60 from rotating). A boss 87 projects outwardly from the rear panel 82 (supported by gussets 87***a*) for attachment of the front mounting bracket 80 to the front end of the dampening mechanism 60. The inward panel 83 extends inwardly from the intersection of the front and rear panels 81, 82; the outward panel 84 extends outwardly from the same intersection, such that the inward and outward panels 83, 84 are generally coplanar. The outward panel 84 shares two triangular gussets 88 with the rear panel 82, and also shares a rib 88*a* that extends between the boss 87 and the outward panel 84. The outward panel 84 also has two open ended slots 89 on its outer edge. Upper and lower vertical walls 90*a*, 90*b* extend upwardly and downwardly, respectively, from the gussets 88 to the upper and lower edges of the outward panel 84. A respective stop 91*a*, 91*b* extends inwardly from each of the upper and lower vertical walls 90*a*, 90*b*.

Figure 10:
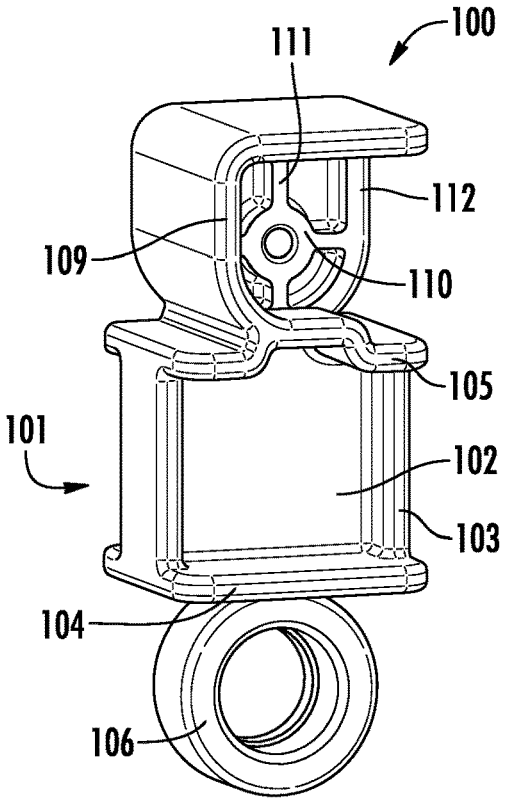
FIG. 10 is a rear perspective view of the rear mounting bracket of the mounting hardware for the cabinet of FIG. 1.
Figure 11:
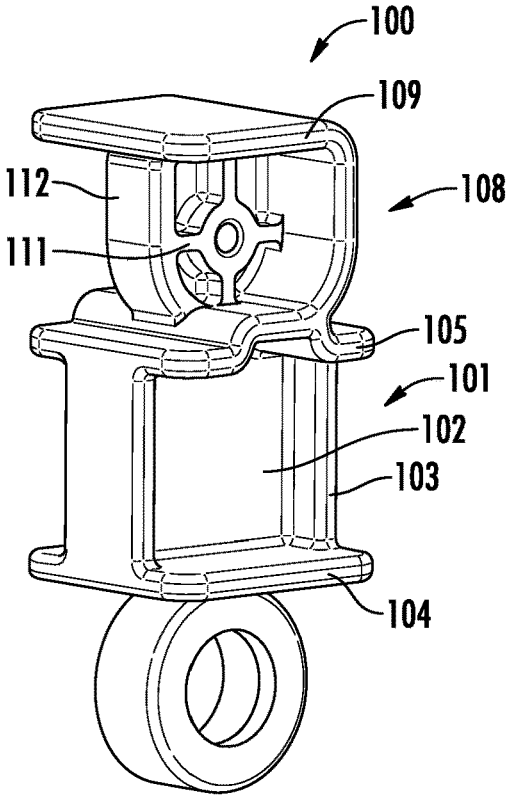
FIG. 11 is a front perspective view of the rear mounting bracket of FIG. 10.

Referring now to FIGS. 10 and 11, the rear mounting bracket 100 has a main body 101 that includes a panel 102, side walls 103, a lower shelf 104 and an upper shelf 105; each of the side walls 103 and shelves 104, 105 extend both inwardly and outwardly from the panel 102. A circular magnet receptacle 106 serves as the lower mounting portion and extends downwardly from the lower shelf 105 and contains a magnet 107 therein (the magnet 107 is absent from FIGS. 10 and 11, but is visible in FIG. 3). A mounting portion 108 extends upwardly from the upper shelf 105. The mounting portion 108 is surrounded on three sides (top, bottom, and rear) by a rim 109. A boss 110 is located within the rim 109 for mounting of the rear mounting bracket 100 to the rear end of the dampening mechanism 60; the boss 110 is supported by ribs 111. A front wall 112 is narrower than the rim 109 and extends between the upper and lower runs of the rim 109.

As can be seen in FIGS. 3-5, the stationary member 51 of the drawer slide 50 is mounted via screws to the side edge 32 of the cutout area 33 of the front wall 28 and rests on the lower edge 34. The stationary member 51 is also mounted to the rear wall 22. The sliding member 52 of the drawer slide 50 is mounted to the side wall 42 of the drawer 40. Sliding movement of the slide member 52 relative to the stationary member 51 enables the drawer 40 to slide in and out of the cabinet 20.

The activator 70 is mounted to the outer surface of the side wall 42 of the drawer 40 via screws inserted into the mounting holes 73 (see FIG. 6). The activator 70 is positioned so that, when the drawer 40 is closed, the catch member 72 of the activator 70 is positioned in the slot 63 of the hook 62 of the dampening mechanism 60.

Best seen in FIGS. 4 and 5, the front mounting bracket 80 is employed to mount the front end of the dampening mechanism 60 to the cabinet 20. More specifically, the front end of the dampening mechanism 60 is received within the "pocket" formed by the rear panel 82 and the upper and lower flanges 86*a*, 86*b*. A screw extends through a hole in the dampening mechanism 60 and into the boss 87 to fix these components together. The outward panel 84 overlies the rear surface of the front wall 28 of the cabinet 20 and may be attached thereto with screws inserted into the slots 89. The lower stop 91*b* rests on the upper surface of the stationary member 51 of the drawer slide 50. The front panel 81 overlies the side edge 32 of the cutout area 33 and is fixed thereto with a screw inserted into the mounting hole 85. The front end of the dampening mechanism 60 abuts the inward panel 83.

Best seen in FIG. 3, the rear mounting bracket 100 is employed to attach the rear end of the dampening mechanism 60 to the stationary member 51 of the drawer slide 50. More specifically, the rear end of the dampening member 60 fits within the rim 109 of the mounting portion 108, with the inward edge of the front wall 112 abutting the dampening mechanism 60, and a screw is inserted into the boss 110 to fix the components together. The magnet receptacle 106 is positioned on the outer surface of the stationary member 51, with the magnet 107 serving to attach the rear mounting bracket 100 to the stationary member 51. The lower shelf 104 rests on the upper surface of the stationary member 51.

The relative positioning of the various components can help to ensure proper alignment of the drawer 40 and dampening mechanism 60. The dampening mechanism 60, the front mounting bracket 80, and the rear mounting bracket 100 can be pre-assembled as provided as a unitary assembly. The stationary member 51 of the drawer slide 50 can be mounted to the rear wall 22 of the cabinet 20 and to the side edge 32 of the cutout area 33 of the front wall 28. The sliding member 52 of the drawer slide 50 is attached to the drawer 40 as described above. The assembly of the dampening mechanism 60, the front mounting bracket 80 and the rear mounting bracket 100 can then be attached quickly and easily to the stationary member 51 and the cutout area 33. The front panel 81 provides lateral alignment relative to the side edge 32, the outward panel 84 provides "fore-and-aft" alignment relative to the front wall 28, and the lower stop 91*b* provides vertical alignment relative to the stationary member 51. The rear mounting bracket 100 (via the lower shelf 105) maintains the rear end of the dampening mechanism 60 at the proper height relative to the stationary member 51 while being very simple to attach to the stationary member 51. The activator 70 can also be easily attached in the correct position on the drawer 40 via pre-drilled holes, a template or the like.

In addition, because the dampening mechanism 60 is oriented with the hook 62 extending downwardly, it is unlikely that the dampening mechanism 60 will inadvertently disengage from the catch member 70 (and therefore from the drawer 40). As noted above, such disengagement may occur in prior cabinets if the drawer 40 is lifted during opening. However, in the arrangement shown in FIGS. 1-7, lifting of the drawer 40 only causes the catch member 72 of the activator 70 to rise more deeply into the slot 63, such that the drawer 40 and dampening mechanism 60 do not disengage.

It is also notable that any or all of the activator 70, the front mounting bracket 80 and the rear mounting bracket 100 may be employed on both sides of the drawer 40. The activator 70 is clearly mirror-symmetric and can be used on either side. The rear mounting bracket 100 has a plane of mirror symmetry that passes through and is coplanar with the panel 102 of the main body 101, so it can also be used on either side of the drawer 40. The front mounting bracket 80 has a horizontal plane of mirror symmetry that passes through the boss 87, so that the front mounting bracket 80 can be inverted, with the upper stop 91*a* becoming the lower stop 91*b* and vice versa, to enable the front mounting bracket 80 to serve on the opposite side of the drawer 40. The dual use of these components can reduce tooling and manufacturing costs, particularly if these components are formed by injection molding of a polymeric material.

Those of skill in this art will appreciate that the illustrated and described arrangement may take other forms. For example, the front mounting bracket 80 may be attached to the cabinet 20 via other means, such as staples, nails, bolts and the like. The activator 70 may also be attached to the drawer 40 by other means, such as staples, nails, bolts and the like. Either of these components may include one or more pins, posts, or other protrusions that are received in their mating surfaces to permit proper positioning and alignment. The rear mounting bracket 100 may also be attached to the dampening mechanism by another technique besides a magnet (e.g., a latch, a hook, or the like). Other configurations may also be possible. It should also be noted that, for some drawers only one dampening mechanism 60 may be employed, whereas on other drawers (typically larger drawers), a dampening mechanism 50 may be employed on each side of the drawer to add further "soft-closing" capability.

Figure 12:
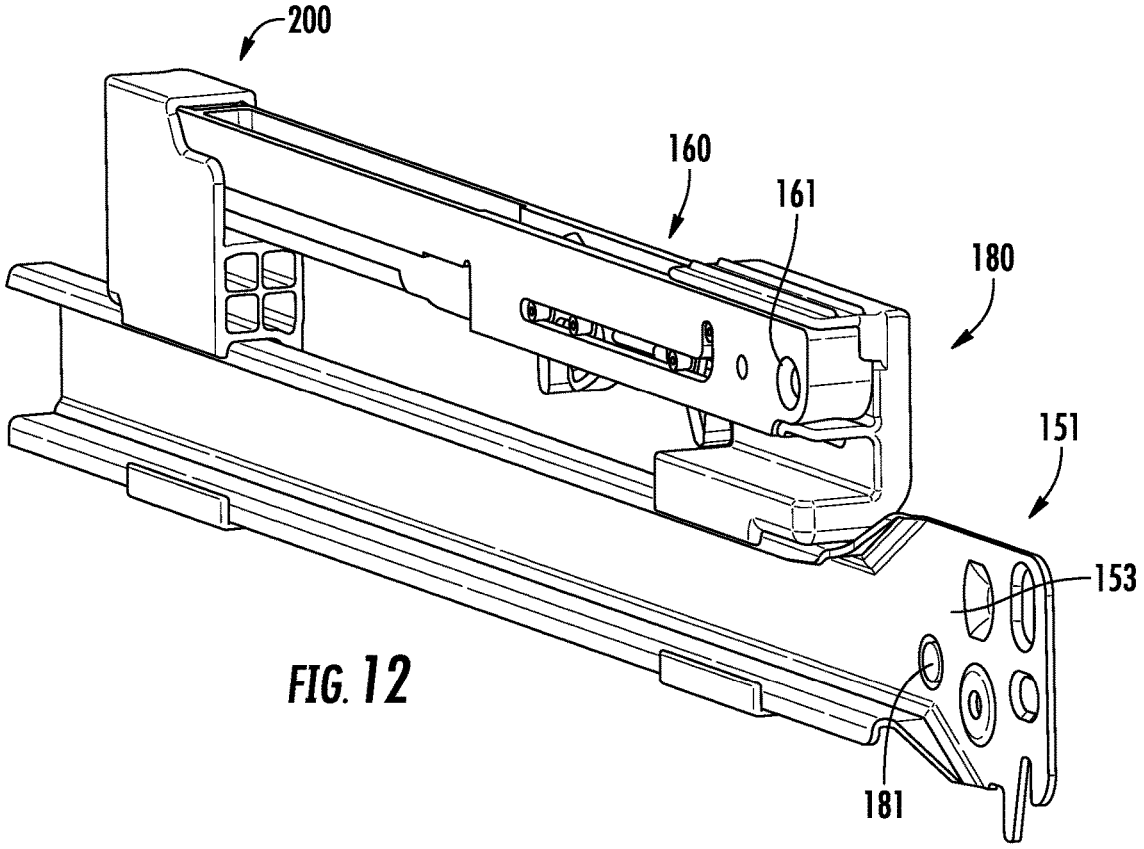
FIG. 12 is an interior front perspective view of a dampening mechanism, a front mounting bracket and a rear mounting bracket according to alternative embodiments of the invention.
Figure 13:
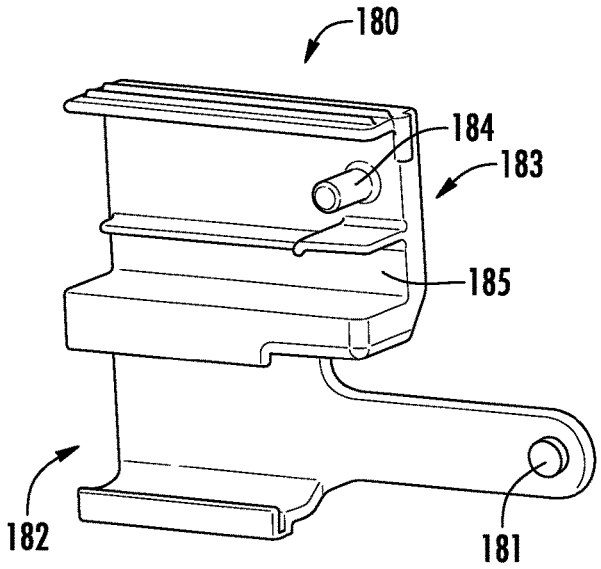
FIG. 13 is a front perspective view of the front mounting bracket of FIG. 12.
Figure 14:
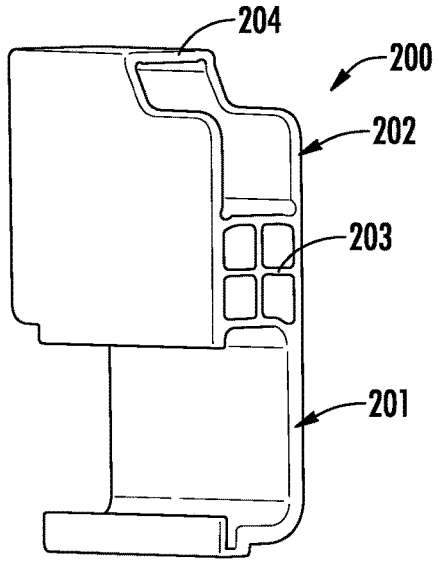
FIG. 14 is a rear perspective view of the rear mounting bracket of FIG. 12.

FIGS. 12-14 illustrate another embodiment that utilizes a different drawer slide (represented by the stationary member 151), front mounting bracket 180 and rear mounting bracket 200. The stationary member 151 is mounted to the cabinet in a manner similar to that described above. The front mounting bracket 180 includes a lower receptacle 182 that receives and clamps onto the front end of the stationary member 151. A nub 181 fits within a hole 153 in the stationary member 151 for alignment. The front mounting bracket 180 also includes an upper receptacle 183 that receives and clamps onto the front end of the dampening mechanism 160. A post 184 is received in a hole 151 on the dampening mechanism 160 for fixing the components together and for alignment. A channel 185 is present between the lower and upper receptacles 182, 183 that provides a path for the catch member of the activator (not shown herein) to travel in during sliding movement of the drawer.

The rear mounting bracket 200 includes a lower receptacle 201 that receives and clamps onto the stationary member 151. An upper receptacle 202 is present above the lower receptacle 201, with spacing ribs 203 positioned therebetween to locate the upper receptacle 202 at the correct height above the stationary member 151 and a ceiling 204 to capture the dampening mechanism 160 from above. The upper receptacle 202 is closed at its rear end.

Figure 15:
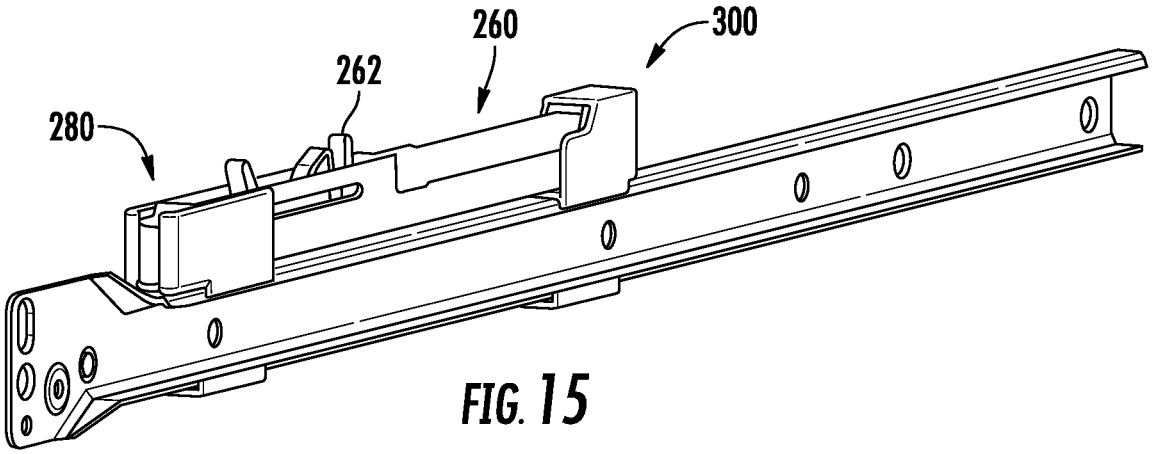
FIG. 15 is an interior front perspective view of a dampening mechanism, a front mounting bracket and a rear mounting bracket according to further embodiments of the invention.
Figure 16:
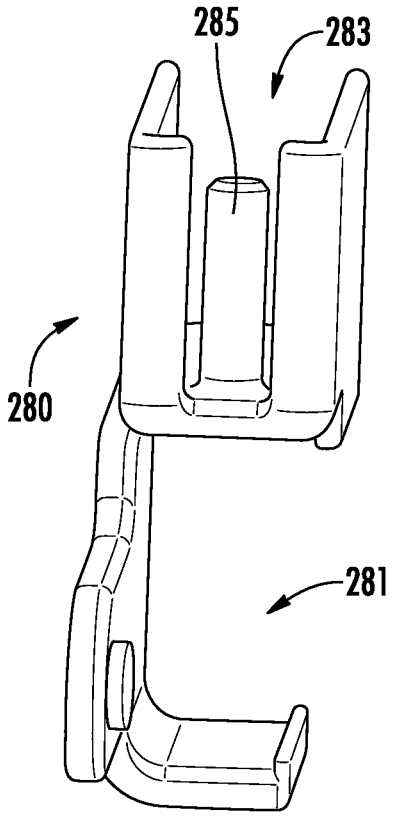
FIG. 16 is a front perspective view of the front mounting bracket of FIG. 15.
Figure 17:
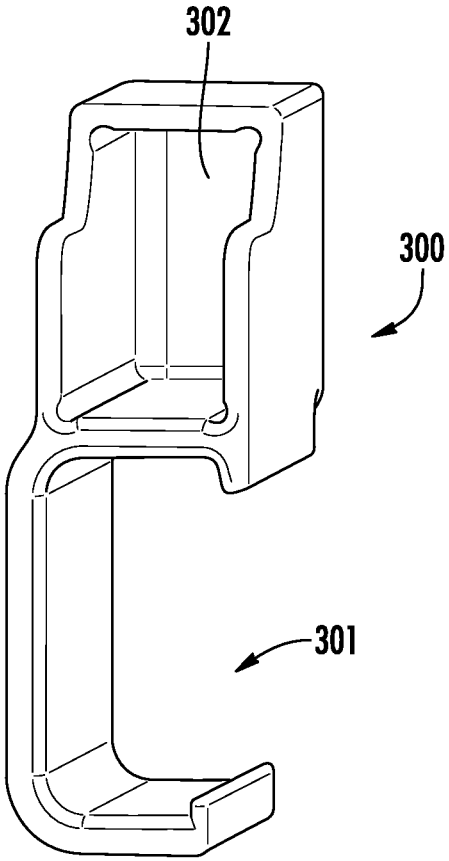
FIG. 17 is a front perspective view of the rear mounting bracket of FIG. 15.

A variation of the assembly of FIGS. 12-14 is shown in FIGS. 15-17. In this embodiment, the dampening mechanism 260 is oriented so that the hook 262 extends upwardly (rather than downwardly as in the dampening mechanisms 60, 160). The front mounting bracket 280 includes lower and upper receptacles 281, 283, but does not have a channel between the receptacles 281, 283. A post 285 extends upwardly from the floor of the upper receptacle 283 to engage a hole in the lower surface of the dampening mechanism 260. The rear mounting bracket 300 lacks the spacing ribs of the rear mounting bracket 200, such that the upper receptacle 302 is directly above the lower receptacle 301. This arrangement enables the use of the dampening mechanism 260 which, as described, has an upwardly-extending hook 262 (the catch member of the activator mounted to the drawer, which is not shown herein, would be mounted higher on the wall of the drawer to be located for proper engagement with the hook 262).

Those skilled in this art will appreciate that the embodiments shown in FIGS. 12-17 are not "universal", in that left- and right-handed brackets are used therein, which may increase tooling and labor costs.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An assembly to be mounted on a drawer slide to provide dampening to a drawer for an enclosure, the enclosure including a front wall having a cutout area with merging lower and side edges, the drawer slide including a stationary member mounted to the enclosure and a sliding member attached to the drawer, the assembly comprising:

a dampening mechanism having front and rear ends, the dampening mechanism configured to prevent slamming of the drawer during closing and to maintain the drawer in a closed position, the dampening mechanism having a hook that engages an activator mounted on the drawer;

a front mounting bracket attached to the front end of the dampening mechanism, the front mounting bracket configured to mount to and engage the side edge of the enclosure and the stationary member of the drawer slide; and a rear mounting bracket attached to the dampening mechanism rearwardly of the front mounting bracket, the rear mounting bracket configured to mount to and engage the stationary member of the drawer slide.

2. The assembly defined in claim 1, wherein the front mounting bracket is configured to engage an upper edge of the stationary member.

3. The assembly defined in claim 2, wherein the rear mounting bracket is configured to engage an upper edge of the stationary member.

4. The assembly defined in claim 3, wherein the hook of the dampening mechanism extends downwardly.

5. The assembly defined in claim 1, wherein the rear mounting bracket includes a magnet employed to attach the rear mounting member to the stationary member.

6. The assembly defined in claim 2, wherein the front mounting bracket engages a rear surface of the front wall of the enclosure.

7. The assembly defined in claim 1, in combination with the drawer slide.

8. The assembly defined in claim 7, in combination with the enclosure.

9. The assembly defined in claim 8, in combination with the drawer.

10. A mounting bracket for mounting a dampening mechanism to a stationary member of a drawer slide, comprising:

front, rear, inward and outward panels, wherein the front and rear panels are generally parallel, and the inward and outward panels are generally parallel to each other and generally perpendicular to the front and rear panels; and a first vertical wall extending rearwardly from the outward panel, the first vertical wall including a lower stop configured to engage the stationary member of the drawer slide;

further comprising upper and lower flanges extending inwardly from the rear panel, the upper and lower flanges configured to capture the dampening mechanism.

11. The mounting bracket defined in claim 10, further comprising a second vertical wall extending rearwardly from the outward panel in a direction opposite the first vertical wall.

12. The mounting bracket defined in claim 10, further comprising a boss extending outwardly from the rear panel.

13. The mounting bracket defined in claim 10, further comprising a mounting hole in the front panel.

14. The mounting bracket defined in claim 10, wherein a front surface of the inward panel and front surface of the outward panel are substantially coplanar.

15. The mounting bracket defined in claim 10, wherein the mounting bracket has a horizontal plane of mirror symmetry that divides each of the front panel, the rear panel, the inward panel and the outward panel into identical mirror images.

16. A mounting bracket for mounting a dampening mechanism to a stationary member of a drawer slide, comprising:

a main body with a lower shelf;

a lower attachment portion extending downwardly from the lower shelf, the lower attachment portion configured to attach to the stationary member, and the lower shelf configured to engage an upper edge of the stationary member; and an upper mounting portion extending upwardly from the main body, the upper mounting portion configured to receive and attach to a rear end of the dampening mechanism wherein the lower attachment portion includes a magnet receptacle and a magnet mounted therein.

17. The mounting bracket defined in claim 16, wherein the upper mounting portion includes a boss that extends outwardly therefrom.

18. The mounting bracket defined in claim 16, wherein the mounting bracket has a vertical plane of mirror symmetry that divides the upper mounting portion, the main body and the lower attachment portion into identical mirror images.

* * * * *